United States Patent [19]

Anderson

[11] 4,276,002

[45] Jun. 30, 1981

[54] TURBOPUMP UNIT FOR DEEP WELLS AND SYSTEM

[76] Inventor: James H. Anderson, 2422 S. Queen St., York, Pa. 17402

[21] Appl. No.: 18,882

[22] Filed: Mar. 9, 1979

[51] Int. Cl.[3] ..... F04B 17/00

[52] U.S. Cl. ..... 417/405; 415/112; 417/360

[58] Field of Search ..... 415/110, 111, 112, 116; 417/360, 379, 405, 406, 409

[56] References Cited

U.S. PATENT DOCUMENTS

| | | | |
|---|---|---|---|
| 2,710,579 | 6/1955 | Kriegbaum | 417/409 X |
| 2,726,606 | 12/1955 | Davidson | 417/409 X |
| 3,288,075 | 11/1966 | Lung | 415/112 |
| 3,620,639 | 8/1970 | Gaffal et al. | 415/122 X |
| 3,907,463 | 9/1975 | Eller et al. | 417/360 |
| 3,981,626 | 9/1976 | Onal | 417/405 X |

*Primary Examiner*—Christopher K. Moore

[57] ABSTRACT

An improved turbopump unit and system for pumping hot geothermal liquids from deep wells to the earth's surface. The unit is of simplified single-shaft construction with reduced net reaction thrust on the shaft. Bearing wear is minimized by using hydrostatic bearings and by supplying lubricating liquid thereto which is taken from an intermediate stage of a centrifugal pump at the surface which supplies motive liquid to the turbine. An arrangement is provided that is operated by pressure of the lubricating liquid for maintaining all thrust-engageable surfaces carried by the shaft out of engagement at start-up and shut-down. Means operated by liquid pressure are provided for sealing the unit to the well casing and also for preventing undue tensile or compressive stresses in the supply conduit for the turbine motive liquid while maintaining an effective seal between the unit and the well casing.

34 Claims, 19 Drawing Figures

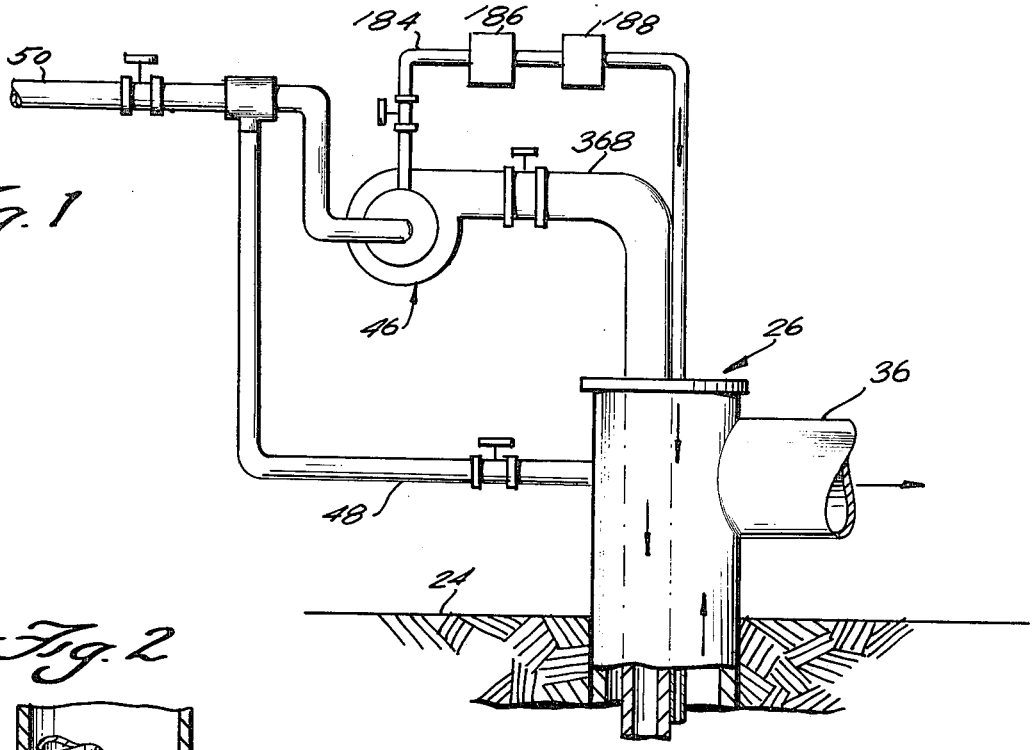
Fig. 1
Fig. 2
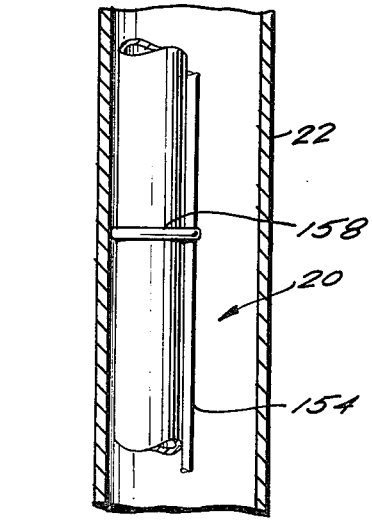
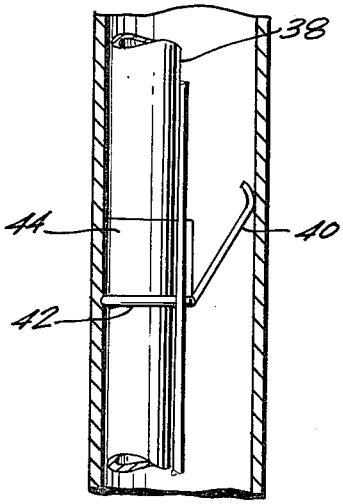
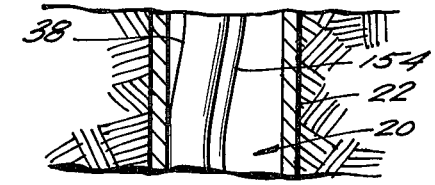
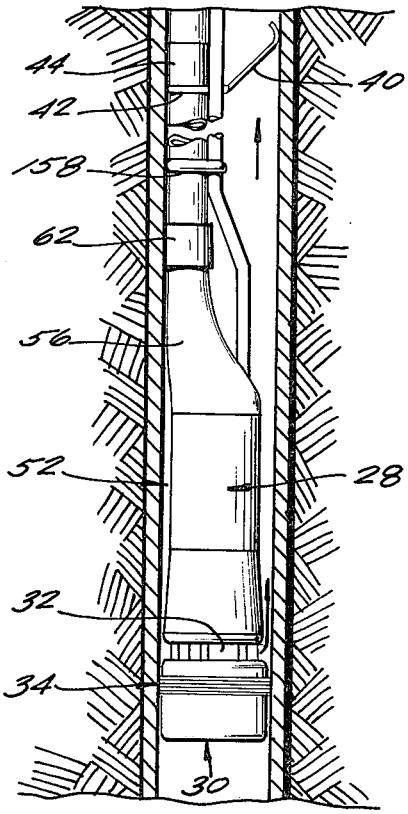

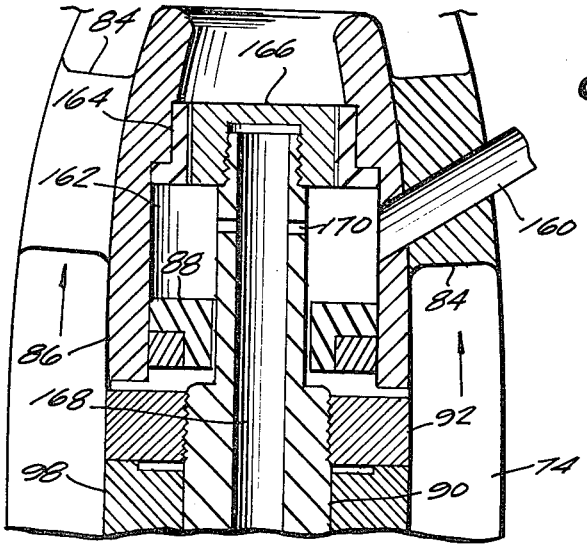
Fig. 4
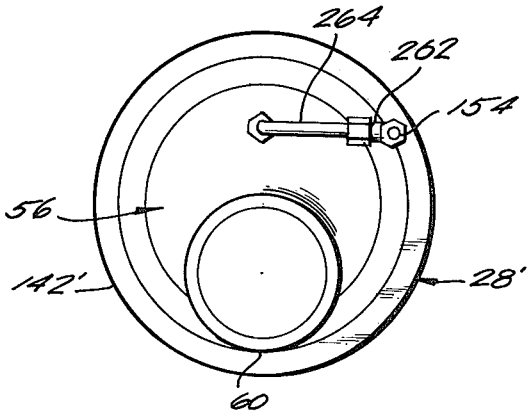
Fig. 7
Fig. 5
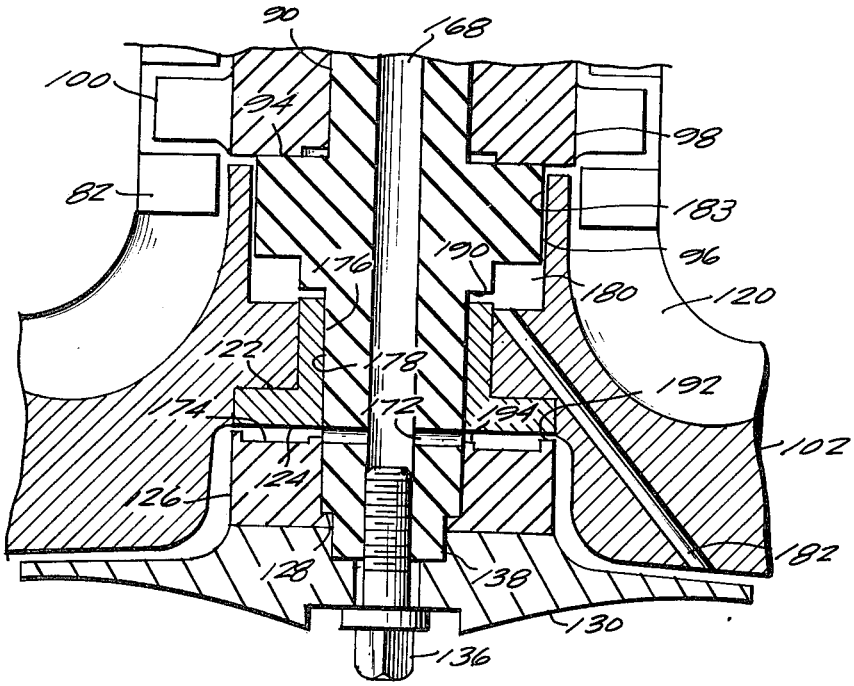

Fig. 11
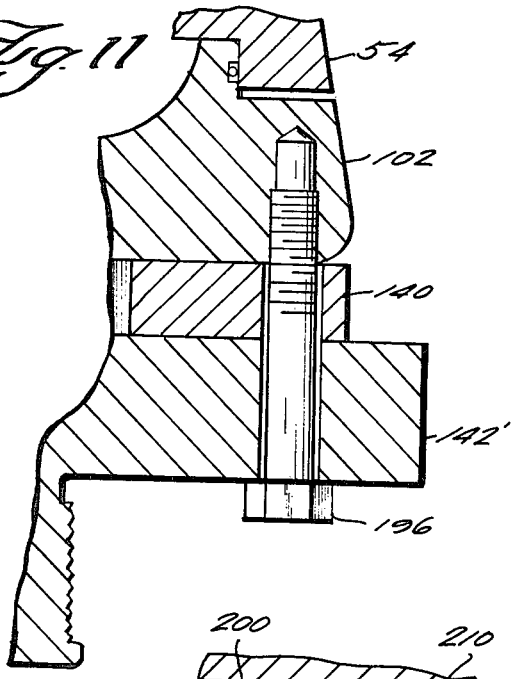
Fig. 17
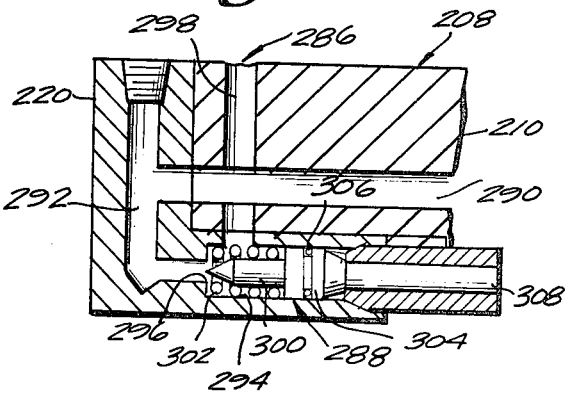
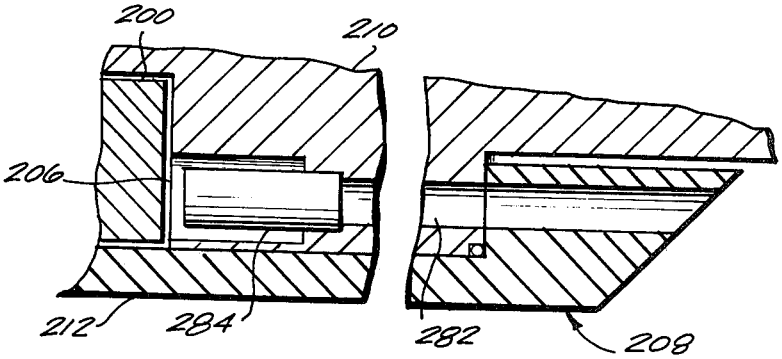
Fig. 16
Fig. 12
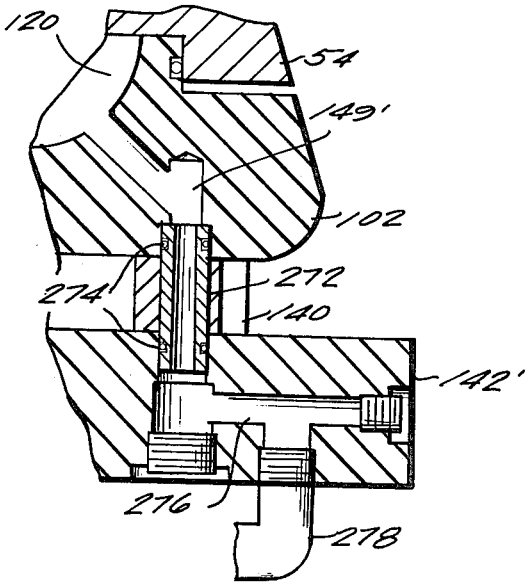

Fig. 13
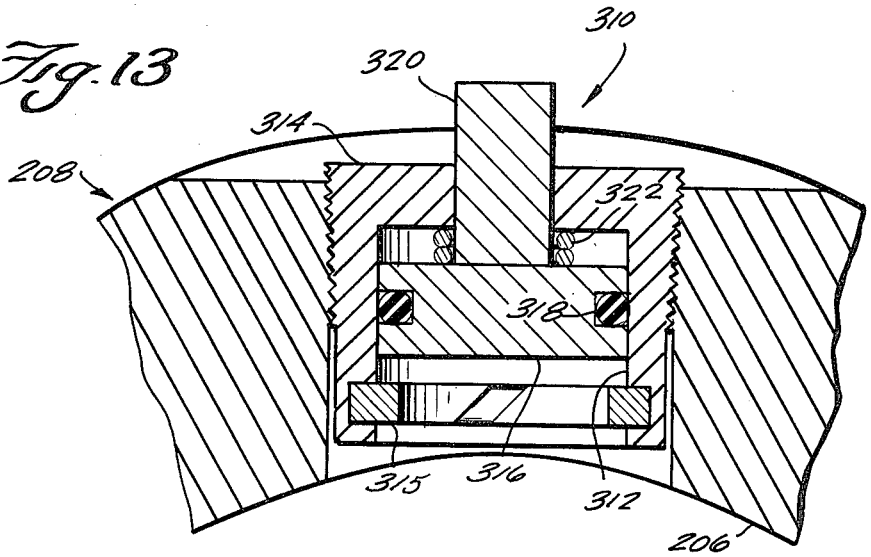
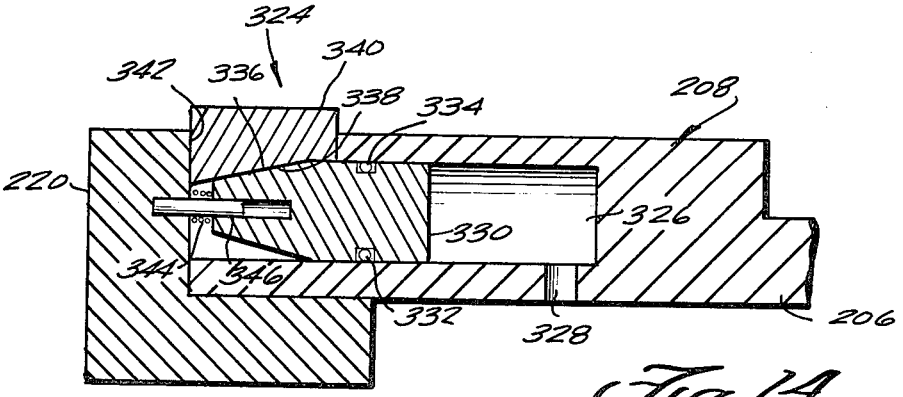
Fig. 14
Fig. 15
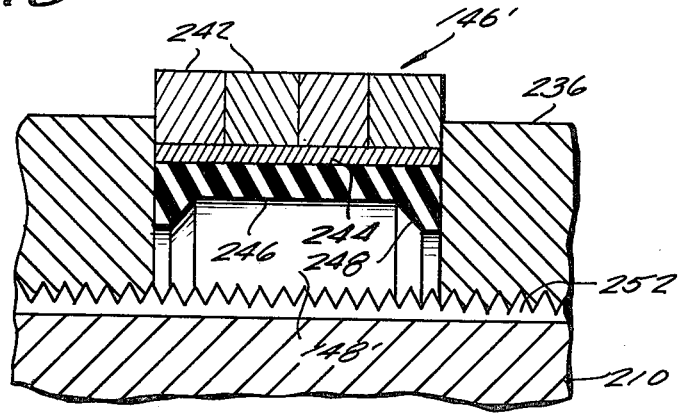

Fig. 18
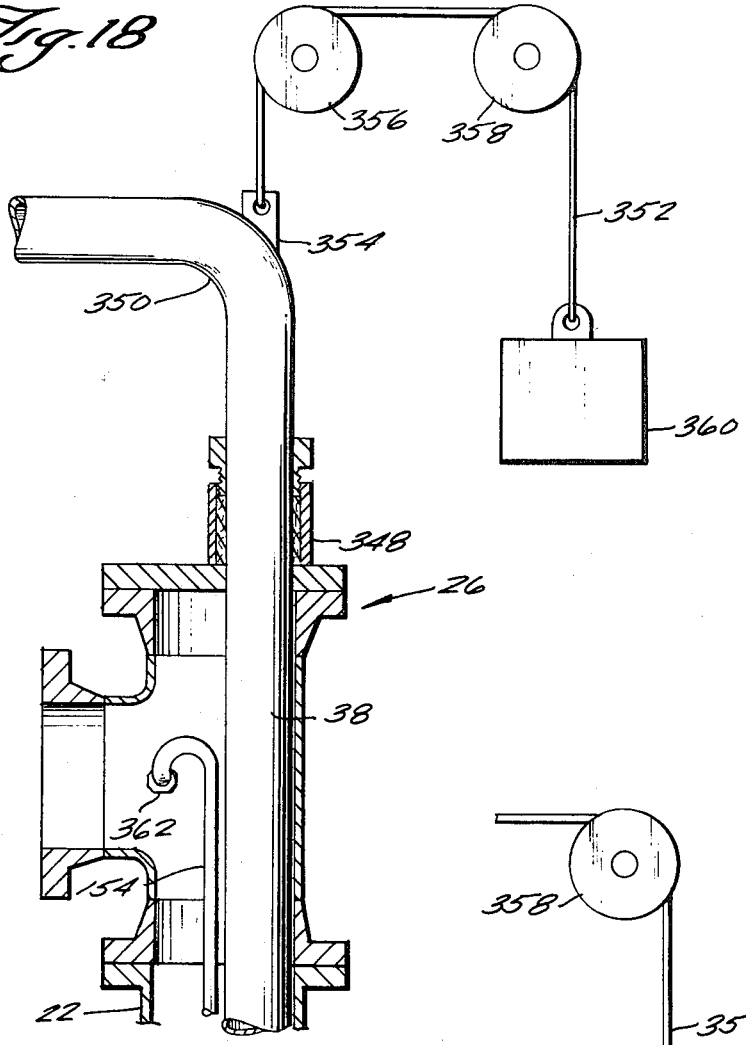
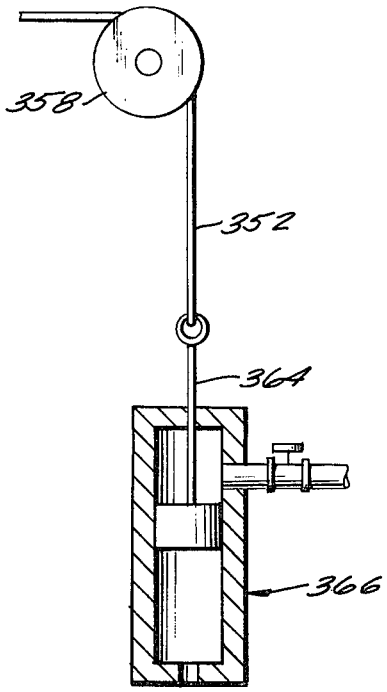
Fig. 19

TURBOPUMP UNIT FOR DEEP WELLS AND SYSTEM

FIELD OF THE INVENTION

This invention relates to improvements in turbopump units and systems for pumping hot geothermal liquids, usually water, from deep wells to the earth's surface for use, for example, in geothermal power plants.

BACKGROUND OF THE INVENTION

In a very deep hot water well temperatures may be of the order of 400°-500° F. with a corresponding vapor pressure of several hundred pounds per square inch. When pumping such hot water to the surface, the pressure must be kept high enough to prevent boiling and flashing into steam, both at the pump inlet and at the surface. Accordingly, it is necessary to submerge any pump for such hot water very deep therein, i.e. to depths of as much as 800 feet, in order to maintain vapor pressure at the pump inlet above boiling at the existing water temperature.

The location and environment of such pumps give rise to many problems, most of which render it impractical to drive the pump by a shaft extending from the well mouth. For this reason pumps have been devised and constructed in the form of self-contained units which include a turbine for driving a centrifugal pump. Even so, many problems still exist in supplying motive fluid for the turbine from the surface to depths of the order of 1000 feet or more; minimizing wear on the turbine and pump bearings, both during operation and start-up, at the high temperatures and pressures involved; minimizing leakages in the unit to maximize its efficiency; accomplishing low cost design which will also minimize potential maintenance; effectively sealing the unit to the well casing; avoiding undue, tensile and/or compressive stresses in the motive fluid supply conduit; etc.

Attempts have been made to solve some of the foregoing problems, as exemplified by the disclosures of the following patents: Bigelow, U.S. Pat. No. 1,894,393; Harney, U.S. Pat. No. 3,171,629; and Nichols, U.S. Pat. No. 3,961,899. None of the prior attempts, however, have been completely successful.

SUMMARY OF THE INVENTION

Accordingly, it is an object of this invention to provide an improved turbopump unit for pumping hot geothermal liquids from deep wells which is economical to construct and operate but which has high efficiency with minimum losses and with lower potential maintenance costs.

It is another object of this invention to provide such a unit which minimizes bearing wear, both during running and start-up.

It is another object of this invention to provide such a unit which can be effectively sealed to the well casing while avoiding undue tensile and/or compressive stresses in the turbine motive fluid supply conduit.

It is a further ojbect of this invention to provide an improved practical system, which includes such a unit, for pumping hot geothermal liquids from deep wells to the surface for utilization, for example, in a geothermal power plant.

The foregoing objects are accomplished by the provision of a turbopump unit that is of simplified single-shaft construction and wherein reaction down-thrust on the shaft by the centrifugal pump is counteracted by reaction up-thrust on the shaft by the turbine to reduce the net thrust on the shaft. Preferably the turbine is supplied with motive fluid by a surface-located multistage centrifugal pump having its inlet connected to the casing head to receive hot water pumped upwardly thereto. Bearing wear is minimized by supplying lubricating liquid under high pressure from the surface to the bearings which preferably are of a hydrodynamic design. Lubricating liquid preferably is hot water taken from an intermediate stage of the turbine-supplying surface pump and cooled and filtered before being supplied to the unit. A unique feature is an arrangement operated by lubricant pressure for maintaining all thrust-engageable surfaces carried by the shaft out of engagement at start-up and shut-down when shaft speed is insufficient for adequate hydrodynamic lubrication. A further feature is the provision of means operated by pressure of the turbine motive fluid for sealing the unit to the well casing to prevent leakage from the pump discharge back to the pump inlet. Still another feature is the provision of means for preventing undue tensile or compressive stresses in the motive fluid supply conduit while maintaining an effective seal between the unit and the well casing.

Other objects and advantages of the invention will become apparent from the following description and accompanying drawings in which:

BRIEF DESCRIPTION OF THE DRAWINGS

FIG. 1 is a diagrammatic elevational view, partly in vertical section, of a system embodying the present invention.

FIG. 2 is an enlarged fragmentary view of a portion of FIG. 1.

FIG. 4 is an enlarged fragmentary view of a portion of FIG. 3.

FIG. 5 is an enlarged fragmentary view of another portion of FIG. 3.

FIG. 7 is a top view of the unit in FIG. 6.

FIG. 11 is an enlarged fragmentary sectional view taken substantially on line 11—11 of FIG. 9.

FIG. 12 is an enlarged fragmentary sectional view taken substantially on line 12—12 of FIG. 9.

FIG. 13 is an enlarged fragmentary sectional view taken substantially on line 13—13 of FIG. 10.

FIG. 14 is an enlarged fragmentary vertical sectional view, corresponding to FIG. 10, showing a modified arrangement for centering a unit embodying this invention in a well casing.

FIG. 15 is an enlarged fragmentary sectional view of one of the sealing rings shown in FIG. 10.

FIG. 16 is an enlarged fragmentary vertical sectional view corresponding to FIG. 10 but taken along a plane spaced angularly from that of FIG. 10.

FIG. 17 is an enlarged fragmentary sectional view corresponding to FIG. 10 but also taken along a plane spaced angularly from that of FIG. 10.

FIG. 18 is an enlarged fragmentary elevational view partly in vertical section of a modified arrangement for suspending the turbine motive fluid supply conduit at the casing head.

FIG. 19 is a fragmentary view, corresponding to FIG. 18, showing another modified suspending arrangement.

DETAILED DESCRIPTION OF THE INVENTION

Figure 3:
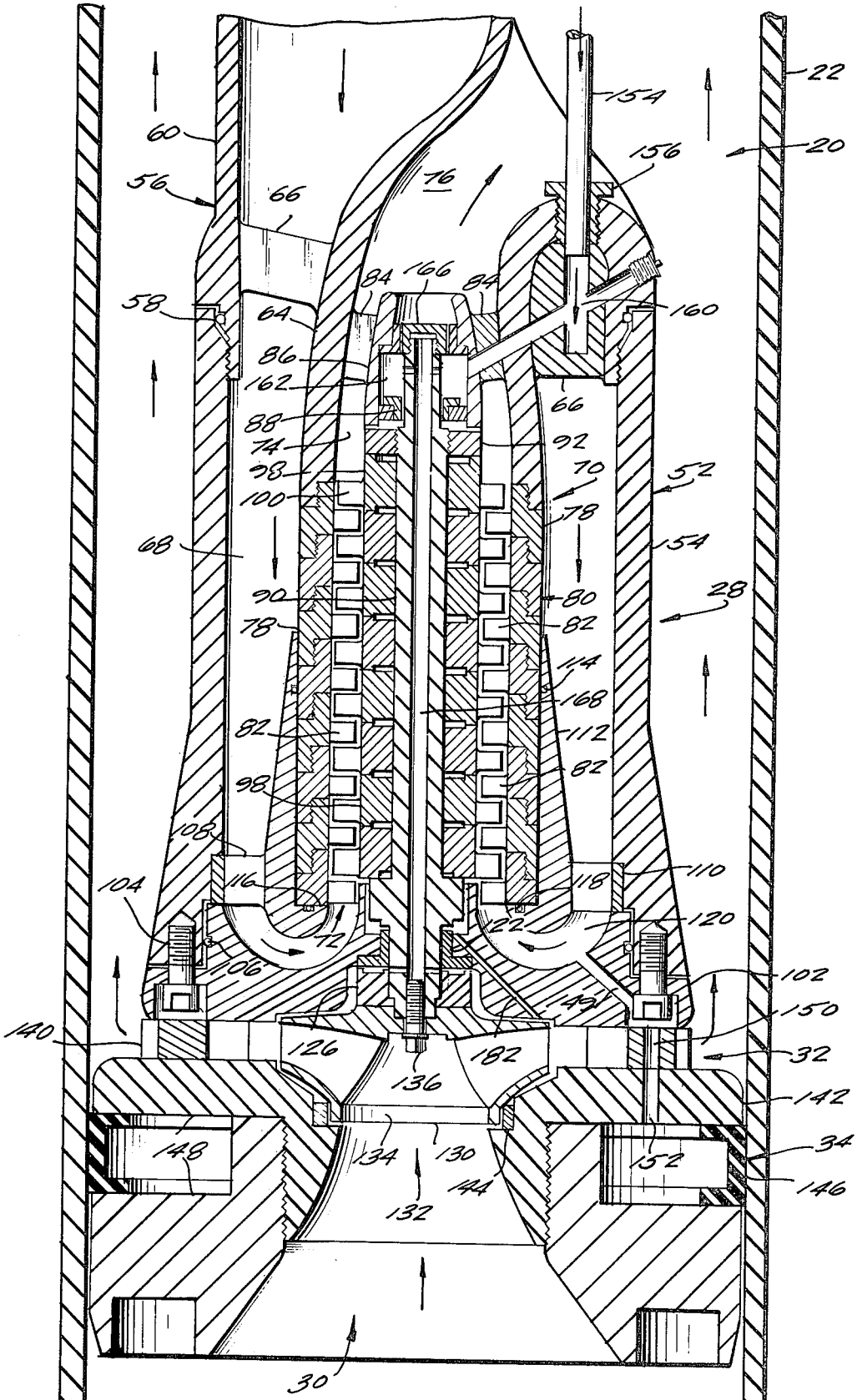
FIG. 3 is an enlarged vertical sectional view of the turbopump unit shown in FIG. 1.

Referring now to the drawings, there is shown in FIG. 1 an exemplary system, in accordance with this invention, for pumping hot geothermal liquid from a deep well to the earth's surface for use, for example, in a geothermal power plant. The system includes the usual deep well 20 provided with a metal casing 22 extending from the surface 24 of the earth to near the bottom of the well and usually cemented in place. The casing 22, typically of the order of 12½" inside diameter, is provided with a closed head 26 to maintain pressure therein.

A generally circular turbopump unit 28 embodying this invention is submerged in the geothermal liquid in the well, usually hot water at a temperature of the order of 400°-500° F., to a water depth of about 800 feet. The overall depth from the surface may be about 1,000 feet. The bottom of the unit has a central downwardly-facing pump inlet 30 above which is located a peripheral pump discharge outlet 32. Below the outlet 32 the unit is provided with a packer arrangement 34 engageable with the well casing 22 to isolate the pump inlet 30 from its outlet 32 and to prevent back leakage so that operation of the unit pump, as later described, will pump hot water upwardly through the casing to the surface 24 where a discharge conduit 36, connected to the casing head 26, conducts the hot water to a point of use, such as a geothermal power plant (not shown). The pressure developed by the unit pump in the casing head 26 is sufficient to prevent the water from flashing into steam at the existing temperature.

The unit 28 is suspended in the well 20 at the lower end of a conduit 38 which supplies fluid, under pressure higher than that of the pump discharge, to the unit for operation of the pump-driving turbine therein. In actual practice the well casing 22 may have, as previously stated, an inside diameter of the order of 12½ and the conduit 38 may have an outside diameter of the order of 5". In order to reduce friction losses of water being pumped upwardly through the casing 22, the majority of the length of the turbine supply 38 conduit is pressed against the side wall of the casing instead of allowing the conduit to depend coaxially therewithin. This can be accomplished, as shown best in FIG. 2, by a plurality of longitudinally-aligned resilient arms 40 each inclined radially outwardly from one end of a circular torsion spring 42 snugly wrapped about the conduit 38, preferably adjacent a coupling collar 44, with the outer end of the arm engaging the side wall of the casing 22. By maintaining the majority of the length of the conduit 38 in such eccentric position, the friction losses of the up-flowing hot water are decreased because the hydraulic mean diameter of the annulus between the casing 22 and the conduit 38 is relatively larger than it would be were the conduit coaxial with the casing. Further, vibration of the conduit 38 due to flow of fluid downwardly therethrough and of water upwardly thereabout is minimized by substantially rigidly securing the conduit against the side of the well casing 22, rather than allowing it to be suspended freely therewith. Minimization of such vibration is important in such a system because of the extreme length of the conduit 38, e.g. a thousand feet or more, and because such conduit must sustain its own weight, and at times sustain the weight of the unit 28 plus the pressure force occasioned by the pressure differential between the pump inlet 30 and its discharge outlet 32. Such differential creates a very large down-pressure force which at times produces tension on the turbine supply conduit 38.

High pressure turbine motive fluid preferably is water supplied by a multistage high-pressure centrifugal pump 46 at the earth's surface 24 which is driven by any appropriate means (not shown). Such motive liquid desirably is obtained by bleeding off from the casing head 26 a portion of the liquid being pumped by the unit 28 and connecting the valved bleed line 48 to the inlet of the surface pump 46. This liquid is supplied by the surface pump 46 to the unit turbine at a pressure, which includes the hydrostatic head in the conduit 38, considerably higher than that of the unit pump discharge outlet 32. A typical geothermal power plant of about 50 megawatts will require about 7 to 15 geothermal wells for full load operation and a surface pump for turbine motive fluid may supply about three wells, i.e. turbopump units 28 embodying this invention. Of course, at start-up the surface pump 46 must be supplied with liquid from another source, such as through a valved supply line 50. After one or more well units 28 supplied by the surface pump 46 have been brought into operation, the surface pump may be supplied entirely with liquid being pumped from the wells.

The unit or well pump typically may be designed to handle 1400 gpm at a discharge pressure of 550 psi above pump inlet pressure. Accordingly, the pressure of the turbine motive liquid at the turbine inlet may be 1100 psi above well pump discharge pressure because turbine exhaust pressure is approximately the same as well pump discharge pressure and turbine exhaust mingles with pump discharge for return to the surface. Manifestly, such high pressures are likely to cause leaks at any liquid passage joints in the unit 28. It is important to minimize the possibility of such leaks because they would have a considerable effect on the economics of the system. The efficiency of the entire system depends largely on the efficiencies of the three principal elements; the surface pump 46, the unit or well turbine and the unit or well pump. For example, as a crude approximation, if the efficiency of each element is 80%, the overall efficiency is 80%×80%×80% or 51.2%. In a geothermal power plant installation, the power to operate the surface pump 46 is supplied by the plant. Hence, a low overall efficiency for the system could result in a serious loss in net power output of the plant. High efficiency of the system can be had only if internal leakage in the unit 28 is held to a minimum. This is accomplished by the provision of tight joints in the static elements of the unit and a minimum of leakage areas in the dynamic elements. Such elements are fewer in number than in known turbopump units.

Referring now to FIGS. 3-5 of the drawings, the turbopump unit 28 embodying this invention includes a mainly circular turbine housing 52 having a main tubular section 54 provided with interior threads at its upper end for engaging exterior threads of a detachable top structure 56 that is sealed to the main section, as by an appropriate O-ring 58. The top structure 56 converges upwardly to one side into an eccentrically disposed inlet section 60 suitably connected, as by a coupling 62, to the lower end of the motive liquid supply conduit 38. The top structure 56 also has a central reduced annular section 64 which depends into the main section 54 and is supported by integral webs 66 to define the upper end of an annular inlet passage 68 for turbine motive fluid. Coaxially supported in the housing 52 is a turbine 70 having a bottom inlet 72 for motive liquid and a top exhaust outlet 74 for spent liquid. At its upper end the central annular section 64 merges into a turbine exhaust passage 76 that curves upwardly and outwardly opposite the inlet section 60 for discharge to the exterior of the unit 28 to mingle spent turbine liquid with the liquid being pumped upwardly through the well casing 22. In operation the exhaust from the turbine 70 preferably is at a pressure about equal to the discharge pressure of the unit pump for improved efficiency of both.

The central annular section 64 has secured to its lower end, as by threaded engagement as shown, a plurality of turbine nozzle or stator vane support rings 78 which, together with the section 64, form an annular casing 80 for the turbine 70. The housing main section 54 and casing 80 define a major portion of the annular inlet passage 68 for turbine motive liquid. Projecting from the inner side of each support ring 78 is an array of stator turbine vanes 82. As shown in the drawings, the turbine 70 may have eight stages with a corresponding number of support rings 78. Secured centrally in the annular section 64, by integral webs 84, is an annular bearing support member 86 having mounted within its lower end a journal bearing 88 (FIG. 4) for the upper end of a turbine shaft 90. Clamped on the shaft 90 between an upper clamp nut 92 and a lower shoulder 94 formed by a shaft enlargement 96 are a plurality of turbine hub sections 98, one for each vane support ring 78, each carrying an array of turbine rotor blades 100 which cooperate with the corresponding turbine stator vanes 82 on the rings. The rotor blades 100 may be, for example, of the order of 3" to 4" in diametric extent and are of the reaction type whereby passage of turbine motive fluid upwardly through the annulus between the turbine casing 80 and the turbine hub 98 creates an up-thrust on the shaft 90.

The lower end of the turbine housing 52 is closed by a centrally apertured bottom plate 102, which may be secured to the housing main section 54 by bolts 104 having countersunk heads and is sealed to the section, as by an appropriate O-ring 106. Supported by integral webs 108 from a ring 110 seated on a ledge in the housing main section 54 and clamped in place by the bottom plate 102, is a turbine shroud 112 which forms a part of the turbine casing 80 and snugly encloses a number, such as six or more, of the support 78 rings and is sealed thereto by an O-ring 114 disposed in an interior circumferential groove adjacent the upper end of the shroud. At its lower end the shroud 112 is provided with an upwardly facing interior shoulder 116 which engages the lowermost support ring 78 and is sealed thereto, as by an appropriate O-ring 118. It will be seen that the shroud 112 minimizes any leakage from the inlet passage 68 inwardly through the nozzle support ring threaded joints. The inner surface of the plate 102 is provided with an annular depression having a convex bottom opposed to and spaced from a convexly rounded lower end of the shroud 112 to define therewith a smooth flow-reversing annular passage 120 for directing motive liquid to the turbine inlet 72 from the annular inlet passage 68.

Coaxially mounted within the plate 102 is a combined journal and thrust bearing 122 for the lower end of the turbine shaft 90 below the enlargement 96. The bearing 122 has a flat annular face 124 opposed to a thrust collar 126 clamped against a shoulder 128 on the lower end of the shaft 90 by the impeller 130 of a single stage centrifugal pump 132 having a downwardly-facing circular inlet opening 134. The impeller 130 has a socket fitting over the lower end of the shaft 90 and is fastened thereto by a bolt 136. Preferably, the lower end of the shaft below the shoulder 128 is symmetrically non-circular, e.g. square as at 138 (FIG. 5), and the collar 126 and impeller 130 have a complementary fit therewith to prevent rotation therebetween. Diffuser stator vanes 140 for the pump 132 are clamped between the lower side of the plate 102 and a pump shroud 142 which carries an impeller seal ring 144 that surrounds a cylindrical outer surface of the impeller 130 about its inlet 134. The shroud 142 may be secured to the plate 102 by bolts (not shown) extending through the vanes 140. During operation the up-thrust on the shaft 90 imparted by the turbine 70 preferably is somewhat greater than the down-thrust on the shaft imparted by the impeller 130.

Inasmuch as the hot water at the pump inlet 30 is at a pressure considerably lower than that at the pump discharge outlet 32, i.e. the annulus at the outer ends of the diffuser vanes 140, leakage from the pump discharge outlet downwardly between the unit 28 and the well casing 22 back to the pump inlet 30 must be prevented or the efficiency of the pump 132 will be greatly diminished. For this purpose the outer diameter of the shroud 142 is made only slightly less than that of the inner diameter of the casing 22. It will be understood, however, that there must be adequate clearance between the turbopump unit 28 and the well casing 22 to facilitate installation of the unit in a deep well. In order to provide an effective seal, however, to prevent leakage from the pump discharge outlet 32 back to the pump inlet 30, there is provided a packer arrangement 34 in the form of an expansible and contractible seal ring 146 disposed in a circumferential groove 148 in the shroud 142 which can be made in two threadedly engaged parts, as shown, for installation of the seal ring. The seal ring 146 may be made of a suitably reinforced elastomeric material and has its inner side exposed to the pressure of the motive liquid for the turbine 70, as via a passage 149 (FIG. 5) through the plate 102 into a countersink for one of the bolts 104, a passage 150 through one of the pump diffuser vanes 140 and a passage 152 in the pump shroud. Normally the seal ring 146 is contracted back within the circumferential groove 148, but when motive liquid is supplied to the groove beneath the ring at a pressure greater than the pressure of the liquid in the well 20 at the depth to which the unit 28 is submerged, the seal ring will expand into tight sealing engagement with the inner surface of the well casing 22. Such engagement serves the additional purpose of at least partially supporting the unit 28 within the well 20 to somewhat relieve the turbine supply conduit 38 of the weight of the unit and the down-force thereon resulting from the pressure differential in the well 20 above and below the seal ring 146. The aforedescribed seal ring arrangement is of a relatively simple construction to demonstrate the principle involved. In actual practice, however, the arrangement may be substantially implemented, as later described, both in number of rings and their design, in order to perfect the desired function.

One of the major problems encountered with turbopump units of the type with which this invention is concerned, is that of reducing bearing wear, especially thrust bearing water. When a unit of the type described herein is in operation the pump 132 imparts a downforce on the shaft 90 while the turbine 70 imparts an up-force. Preferably, the pump 132 and the turbine 70 are so designed and proportioned that the net force on the shaft 90 is up. Nevertheless, the opposed thrust bearing surfaces, i.e. of the thrust bearing 122 and of the thrust collar 126, will be subjected to considerable wear unless such surfaces are suitably lubricated. The same is true of the opposed journal bearing surfaces, i.e. of the journal bearings 88 and 122 and of the shaft 90. With this in mind such surfaces are designed, as is known in the art, so that they are operated as a hydrodynamic bearing, i.e. the opposed rotating surfaces do not actually contact during operation but, instead, are separated and ride upon a film of lubricating liquid. Such liquid must be supplied under pressure to the surfaces in order to maintain them out of actual contact.

This desirable result is accomplished in a unit embodying this invention by the provision of passages for supplying the lubricant to the inner peripheries of the opposed thrust-bearing surfaces and to the peripheries of the opposed journal-bearing surfaces at one end thereof at a pressure higher than pump discharge pressure, for flow between the opposed bearing surfaces into the liquid being discharged from the pump 132. For this purpose high pressure lubricant liquid is supplied to the unit 28 through a tube 154 leading from the surface 24 to an inlet fitting 156 in the top structure 56 of the unit. Preferably, the tube 154 is secured to the turbine supply conduit 38, as by straps 158 (FIG. 2). A passageway 160 leads from the fitting 156 downwardly and inwardly through one of the webs 66, which may be of extended vertical extent as shown in FIG. 3, thence inwardly through the annular section 64, through one of the webs 84, and through the bearing support section 86 to open into a closed annular space 162 about the shaft 90 above the journal bearing 88 (FIG. 4). Supported by the section 86 above the journal bearing 88 is a seal ring 164 which cooperates with the outer cylindrical surface of an enlargement 166 on the upper end of the shaft 90, which may be in the form of a cap nut. The shaft 90 itself preferably is tubular to form therein an axial lubricant passage 168 which communicates at its upper end with the annular space 162 through radial holes 170. Similar radial holes 172 at the lower end of the shaft 90 (FIG. 5) communicate the axial passage 168 with the inner edges of the opposed surfaces 124 and 194 between the thrust bearing 122 and the thrust collar 126 and similarly with the lower edges of the opposed surfaces 176, 178 between the lower journal bearing 122 and the shaft 90.

In operation a lubricating liquid, preferably hot water as a most desirable practical expedient, under pressure higher than that of the unit pump discharge is supplied to the tube 154. From the tube 154 the lubricant passes downwardly through the aforedescribed passages 160, 168 and holes 170, 172 to the upper peripheries of the opposed surfaces between the upper journal bearing 88 and the shaft 90, to the inner edges of the opposed surfaces 124, 174 between the thrust bearing 122 and the thrust collar 126, and to the lower peripheries of the opposed surfaces 176, 178 between the lower journal bearing 122 and the shaft 90. In operation of the unit 28 the lubricant will flow between the surfaces of each opposed pair under a pressure sufficient to maintain the aforedescribed hydrodynamic film which prevents actual contact between such surfaces. In this connection, the rotation of the collar 126 provides a centrifugal pumping effect on the liquid flowing outwardly between the collar and the thrust bearing 122. The lubricating liquid escapes from such opposed surfaces to mingle with the well liquid being pumped by the pump 132. Thus, at the upper journal bearing 88 the lubricating liquid escapes into the space between the bearing and the clamp nut 92 and thence outwardly into the turbine outlet 74. From the thrust bearing 122 the lubricant escapes into the space between the bottom plate 102 and the impeller 130 and thence to the diffuser nozzles formed by the vanes 140. From the lower journal bearing 122 the lubricant escapes into a closed annular space 180 about the shaft 90 (FIG. 5) and thence through a vent passage 182 in the plate 102 to a point adjacent the periphery of the impeller 130 between the latter and the plate. The annular space 180 is substantially sealed from the motive fluid entering the turbine inlet 72 by close spacing between the cylindrical surface of the shaft enlargement 96 and an interior cylindrical surface 183 on the plate.

As stated before, all the bearing surfaces are of a hydrodynamic design so that in operation they are not in actual contact but are separated by a film of lubricating liquid under high pressure. Additionally, the annular spaces between the opposed surfaces of the journal bearings 88, 122 and the shaft 90 taper in radial dimension in the direction of lubricant flow so that the liquid film between these surfaces tends to center the shaft in the journal bearings.

As a practical expedient it is highly desirable to use water as a lubricant. This may be accomplished by using a part of the output of the surface pump 46 for turbine motive liquid at a pressure higher than well or unit pump 132 discharge pressure. If the centrifugal surface pump 46 has, for example, six stages, the pressure at the outlet of the second stage may well be several hundred psi higher than well pump 132 discharge pressure. Thus, it is practical and economical to bleed off a small amount of high pressure hot water from an intermediate stage of the surface pump 46 for use as a lubricant and supply it to the unit 28 through a valved bleed line 184 connected to the lubricant supply tube 154. Prior to such use, however, the water needs to be cooled and filtered, as in a suitable cooling unit 186 and filtering unit 188, to eliminate all but very fine particles, e.g. of 5 micron size. Cooling tends to precipitate salts which might otherwise precipitate in the shaft bearings of the unit 28 with resulting wear, and such precipitates together with other bearing-damaging particles are removed by subsequent filtering to assure a supply of relatively clean lubricant to the unit.

One of the major problems encountered in a turbopump unit of the aforedescribed type is that of preventing contact between the opposed thrust-bearing surfaces during start-up and shut-down of the unit when shaft speed is insufficient to maintain a hydrodynamic film of lubricating liquid between such opposed surfaces as aforedescribed. A unit 28 embodying this invention, however, incorporates features to provide for separation of all thrust-bearing surfaces during start-up and shut-down. In this connection, when the unit 28 is at rest with no lubricant or motive fluid being supplied thereto, the weight of the rotor, both turbine 70 and pump 132, is supported by a downwardly facing shoulder 190 on the shaft 90 which rests on the upper end of the lower journal bearing 122 (FIG. 5). The opposed surfaces of the shoulder 190 and journal bearing 122 form thrust-bearing surfaces on which wear should be minimized at start-up and shut-down when net shaft thrust, due to rotor weight, is down.

The cylindrical enlargement 166 on the upper end of the shaft 90, which cooperates with the upper seal ring 164, is of a diameter larger than that portion of the shaft which rotates within the upper journal bearing 88. The result is that the enlargement 166 forms a piston on which the lubricating liquid in the annular space 162 acts to exert a constant up-force on the shaft 90. The outer periphery of the thrust collar face 174, or it could be the thrust-bearing face 124, is provided with an axially extending lip or rib 192 (FIG. 5) which maintains the opposed surfaces 124, 174 of the bearing 122 and collar 126 inwardly of such lip out of engagement at all times and, hence, always exposed to the pressure of the lubricating liquid. The areas of these surfaces 124, 174 subject to such pressure are larger than the effective area of the piston 166 at the upper end of the shaft 90 so that when the lubricant pressure between these opposed surfaces is the same as that acting on the piston the effect will be a net down-force on the shaft 90. As stated before, however, the shaft 90 is axially movable to a very limited extent so that the lip 192 can move downwardly out of engagement with the thrust bearing 122. When this occurs the pressure between the aforementioned opposed surfaces 124, 174 will decrease substantially linearly with the separation distance between the lip 192 and bearing 122. This effect is attained even better with the provision of another lip 194 on the inner periphery of the thrust collar 126, or it could be on the thrust bearing 122. The inner lip 194 is, however, of less axial extent than the outer so as to exert a throttling effect on lubricating liquid passing outwardly between the opposed surfaces 124, 174 of the thrust bearing 122 and thrust collar 126.

In accordance with this invention, lubricant is supplied under pressure to the unit 28 just prior to startup and the supply is not shut off until after the unit is shut down. When the unit 28 is at rest, the rotor assembly rests on the lower journal bearing 122 as aforedescribed but when prior to commencement of rotation lubricant is supplied under pressure, the separation of the thrust collar 126 from the thrust bearing 122 reduces the pressure therebetween to such an extent that the piston 166 raises the rotor assembly and moves the shoulder 190 away from the journal bearing 122. As the thrust collar 126 approaches the thrust bearing 122, however, the pressure therebetween increases until its effective down-force, plus the weight of the rotor assembly, balances the up-force of the piston 166. In this position, the outer lip 192 is out of contact with the thrust bearing 122. Hence, when the rotor commences to rotate all the thrust-bearing surfaces are out of actual contact. As the rotor picks up speed the net thrust on the shaft 90 will change to up, as aforedescribed, but then the speed will be sufficient to maintain a hydrodynamic film of lubricant between the opposed surfaces of the lip 192 and the thrust bearing 124. A shut-down the foregoing process is reversed so that all the thrust-bearing surfaces are maintained out of contact until after the rotor comes to rest.

The abovedescribed system and unit 28 are satisfactory for their intended purpose, but problems remain. At start-up of the surface pump 46 the turbine motive fluid supply conduit 38 becomes filled with water at a relatively low temperature taken from the supply line 50, while the water rising within the larger heavier well casing 22 is of an increasing temperature gradient. On the other hand, when a well pump 132 is started and the surface pump 46 is being supplied with hot water from another well, the supply conduit 38 becomes filled with hot water. In either event there will be differential thermal expansion between the well casing 22 and the conduit 38 with the conduit probably expanding and elongating more rapidly than the casing. Thus, to prevent buckling of the conduit 38 or the creation of undue tension stresses therein either the conduit must be allowed to slide through a packing box at the casing head 26 or the unit 28 must be allowed to move vertically within the casing 22. In addition to the foregoing differential thermal expansion, the high pressure in the conduit 38 during operation tends to stretch it to a greater length than when the unit 28 is at rest. Further, there is a considerable pressure differential in the well 20 above and below the unit packer arrangement 34 which creates a large down-force on the unit 28 that tends to stretch the conduit 38 even more while the unit is in operation. If unrestrained, the conduit 38 will even elongate as much as almost a foot or possibly more. After the unit 28 has been in operation for some time the temperatures within and without the supply conduit 38 probably will be equalized to nullify the aforedescribed differential temperature expansion, but this will cause the conduit 38 to either shorten or elongate after a period of operation.

With the packer arrangement 34 described above, if the turbine supply conduit 38 is fixed at the casing head 26, the sealing ring 146 probably will slide along the wall of the casing 22 for a period of time after start-up, and again on shut-down. Such sliding of the sealing ring 146 against the interior of the casing 22 will produce high stresses on the ring and would eventually wear and distort it to such an extent as to severely impair its sealing effectiveness.

The foregoing problem with the sealing ring 146 is aggravated by the fact that the diameter of the pump shroud 142 must be smaller, e.g. approximately ½″ smaller, than the interior diameter of the well casing 22 to accommodate various pieces of dirt, manufacturing tolerances, and installation distortions of the well casing so that the unit 28 can be lowered through the casing for the long distance it must travel to its final operational depth. Thus, with the aforedescribed typical dimensions, the expansible seal ring 146 must expand radially outwardly at least about ¼″ beyond the major diameter of the pump shroud 142. If the shroud 142 is not centered in the well casing 22, however, and is disposed eccentrically therein, the expansible seal ring 146 would have to expand radially outwardly more than ¼″ at that side of the shroud which is farthest from the casing wall. Such an eccentric or offcenter situation would create even higher stresses on that side of the ring 146 which protrudes farthest out of its groove 148.

The foregoing problems are solved or minmized, however, by the modified unit 28′ and system disclosed in FIGS. 6–19 of the drawings. In the system shown therein the conduit 38 is permitted to move vertically at the casing head while at the same time the conduit is suspended or supported from the surface by a counterbalancing arrangement, thus overcoming problems arising from differential thermal expansions or contractions. The modified unit 28' is provided with means for automatically centering it with respect to the well casing 22 so as to avoid the aforedescribed seal problem which will occur when the unit is off center. The arrangement for sealing the unit 28' to the well casing 22 is modified so as to prevent relative sliding movement between the seals and the well casing while at the same time permitting longitudinal movement between the unit itself and the sealing means. Furthermore, means are provided for alleviating the stretching stresses in the turbine supply conduit 38 when the unit 28' is in operation.

Referring now to FIGS. 6–11, the pump diffuser vanes 140 are clamped, by bolts 196 (FIG. 11), between the bottom plate 102 and a modified pump shroud 142' which has threadedly connected thereto an exteriorly reduced depending extension that forms an annular piston rod 198. At its lower end the extension is exteriorly enlarged to form an annular piston 200, as by an annular ring detachably secured to the end of the extension, as by bolts 202, with an appropriate O-ring seal 204. The piston 200 is slidable in an annular cylinder 206 formed in a tubular support housing 208. The outer wall and bottom of the cylinder 206 are formed by a counterbore in the upper end of an outer part 210 of the housing 208, while the cylinder inner wall is formed by a sleeve 212 having an exterior enlargement at its lower end which fits against a downwardly facing interior shoulder 214 in the outer part of the housing and is secured in place by bolts 216 with an appropriate O-ring seal 218 between the lower end of the sleeve and the outer part of the housing.

The upper end of the cylinder 206 is closed by an annular cover 220 which is secured by bolts 222 to the outer part 210 of the housing 208 and has an exteriorly-reduced depending section 224 that fits snugly within the cylinder and is sealed to the outer wall thereof by an appropriate O-ring 226. A seal also is effected between the cover 220 and the outer side of the piston rod 198, as by an O-ring 228 carried in an interior circumferential groove in the cover. Seals also are provided between the piston 200 and the outer and inner walls of the cylinder 206, as by O-rings 230, 232 carried in outer and inner circumferential grooves in the piston.

Figure 10:
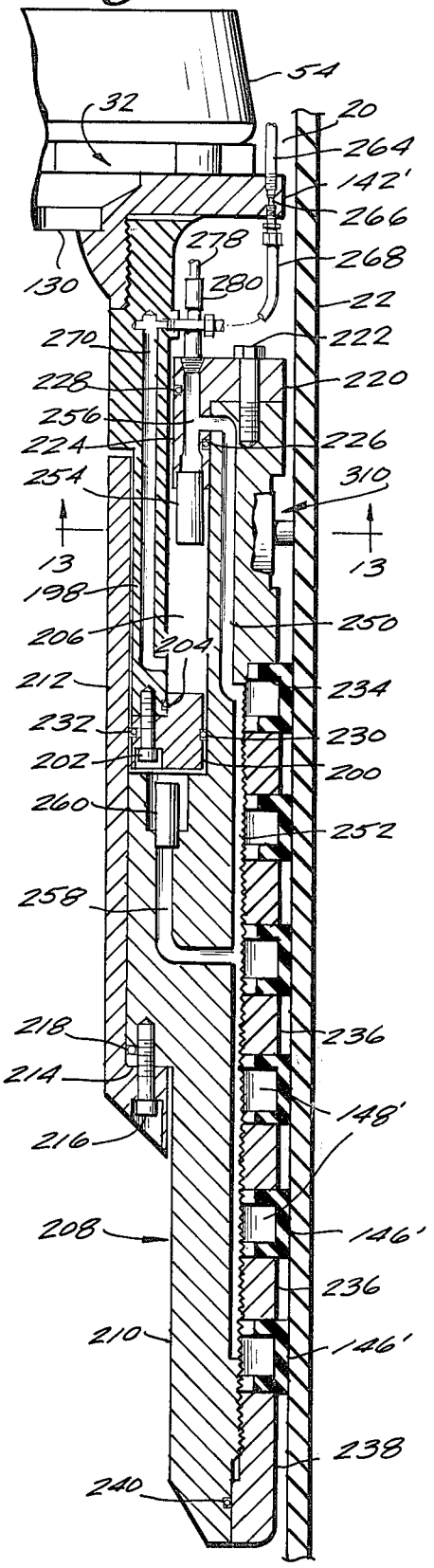
FIG. 10 is an enlarged fragmentary vertical sectional view of the unit shown in FIG. 6. The view is taken with different orientation of the section planes of different portions of the view in order to illustrate and describe structure and mode of operation in a more understandable manner.
Figure 8:
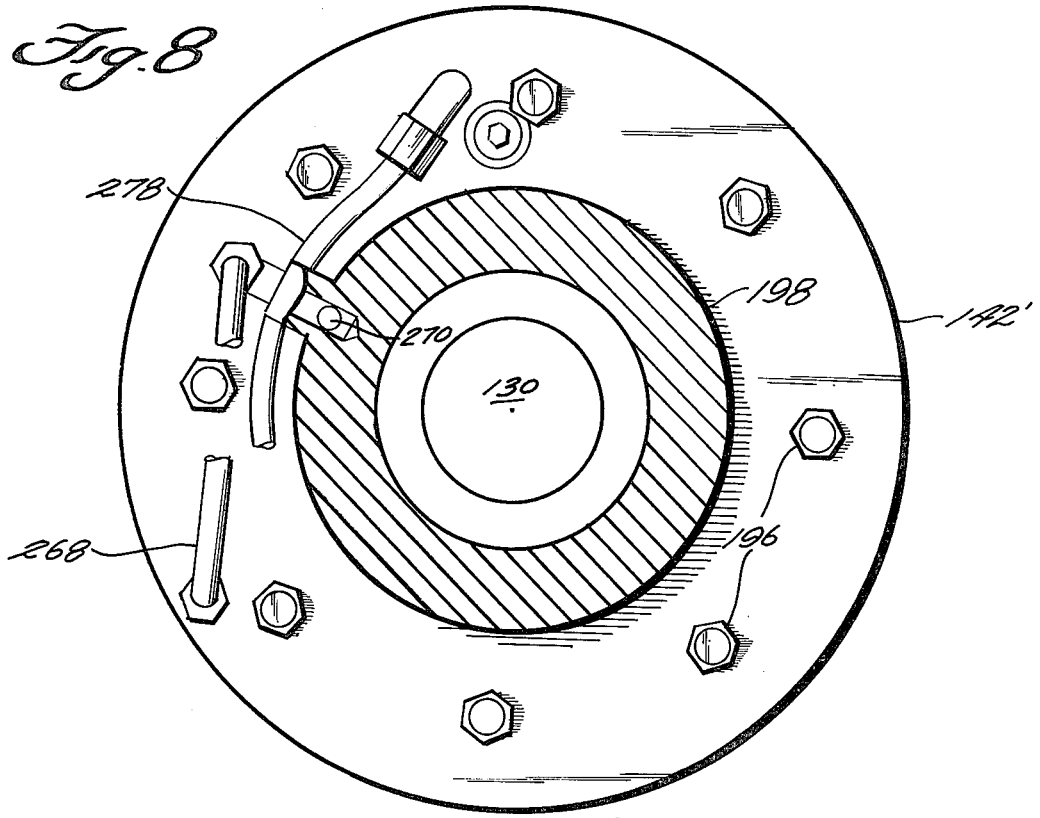
FIG. 8 is an enlarged cross-sectional view taken substantially on line 8—8 of FIG. 6.
Figure 9:
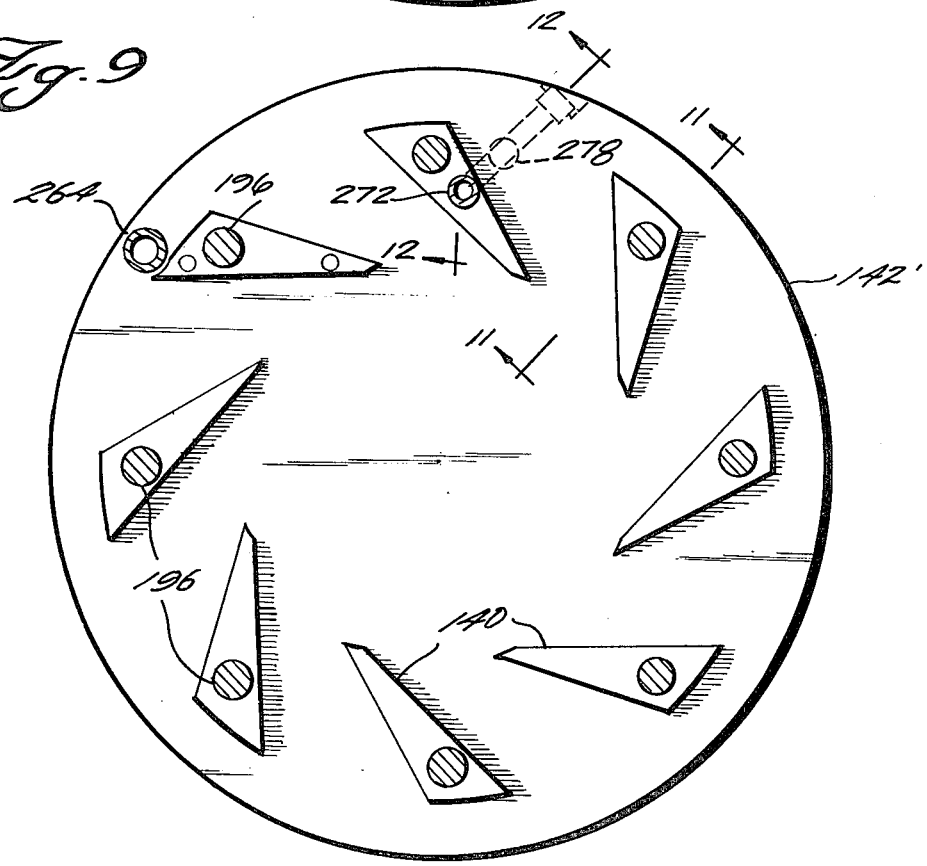
FIG. 9 is an enlarged cross-sectional view taken substantially on line 9—9 of FIG. 6.

At its upper end portion the outer surface of the support housing 208 is generally cylindrical and of a diameter about that of the maximum diameter of the pump shroud 142', e.g. ½" less than that of the interior diameter of the well casing 22 for reasons described heretofore. Below its upper end portion the support housing 208 is provided with a plurality, such as six as shown in FIG. 10, of expansible and contractible sealing rings 146' disposed in longitudinally spaced circumferential grooves 148'. The grooves 148' may be formed by a downwardly-facing shoulder 234, spaced cylindrical nuts 236 threaded onto the outer part 210 of the housing 208 that is exteriorly reduced below the shoulder, and a cap nut 238 threaded onto the lower end of the housing and sealed thereto, as by an appropriate O-ring 240.

As shown in FIG. 15, the sealing rings 146' are of a reinforced construction which includes a plurality of outer metal split piston rings 242, the splits in which are staggered circumferentially so as to minimize leakage past the rings when they are engaged with the inner surface of the well casing 22. The piston rings 242 are backed by a wide flexible band 244 composed of one or two wrappings of a strip of thin sheet metal having overlapping ends. The band is, in turn, backed by a wide elastomeric ring 246 having radially inwardly extending lips 248 at its marginal edges so as to effect a tight seal with the side walls of the grooves 148' when high pressure liquid is introduced into the grooves beneath the sealing rings 146'. If desired, the piston rings 242 may be provided with one or more circumferential grooves to increase their frictional engagement with the inner surface of the well casing 22. It will be seen that the large number of sealing rings 146', together with their reinforced construction, will, when expanded, substantially lock the support housing 208 to the well casing 22 and also minimize any leakage from the pump outlet 32 back to its inlet 30.

A longitudinal passageway 250 in the upper portion of the support housing 208 communicates, at its lower end, with a longitudinal groove 252 which extends between the upper and lower circumferential grooves 148' in the exteriorly threaded portion of the support housing. The interior of the cylinder 206 above the piston 200 communicates, via a one-way relief valve 254 and a passage 256 in the cylinder cover 220 with the upper end of the passageway 250, while the longitudinal groove 252 communicates with the lower end of the cylinder below the piston, via a passageway 258 and another one-way relief valve 260.

Lubricant liquid under pressure is supplied to the cylinder 206 above the piston 200 via a T fitting 262 connected into the lubricant supply tube 154, a tube 264 connected to the stem of the T fitting and, as by threads, to the upper end of a passageway 266 through the pump shroud 142, a flexible tube 268 connected into the lower end of such passageway and into a longitudinal passageway 270 through the annular piston rod 198 which communicates at its lower end with the cylinder 206 above the piston 200.

Turbine motive fluid also is admissible into the passageways 256, 250 via a passage 149' through the bottom plate 102, a short tube 272 extending through a pump diffuser vane 140 and sealed to the plate 102 and pump shroud 142' by O-rings 274, a passage 276 through the pump shroud, and a flexible tube 278 which is connected at one end with the passage 276 through the pump shroud, is wrapped around the reduced shroud extension which forms piston rod 198 (to provide flexibility for accommodating relative movement between the piston rod and the support housing 208) and is connected at its other end, through a check valve 280 (FIG. 6), with the passageway 256 in the cylinder cover 220.

The interior of the cylinder 206 below the piston 200 is vented to the well 20, below the sealing rings 146', via a longitudinal passageway 282 (FIG. 16) in the housing 208 which communicates at its upper end with the lower end of the cylinder and at its lower end with the exterior of the housing. The venting of liquid from the cylinder 206 through the passageway 282 is controlled by a relief valve 284, the opening pressure of which is considerably greater than that of turbine motive fluid normally supplied to the unit 28'.

The spaces in the circumferential grooves 148' beneath the sealing rings 146' are vented to the exterior of the housing 208 above the sealing rings by a vent passageway 286 controlled by a normally-open piston-operated pilot 288 value (FIG. 17). For this purpose there is provided in the outer housing part 210, spaced circumferentially from the passageway 250, another longitudinal passageway 290, which communicates at its lower end with the bottom of the uppermost groove 148', and at its upper end with a passageway 292 in the cover 220 which opens into a cylindrical valve chamber 294 and forms a valve seat 296. The chamber 294 communicates, through a radial passageway 298 spaced circumferentially from the passageway 290, with the exterior of the support housing 208 above the sealing rings 146'. Slidable in the valve chamber 294 is a valve member 300 having a conical end seatable on the valve seat 296. The valve member 300 is normally urged to open position by a coil compression spring 302 so as to vent the spaces in the grooves 148' beneath the sealing rings 146' to the well 20. The other end of the valve member 300 is formed as a piston 304 carrying an O-ring 306 for sealing engagement with the cylindrical wall of the valve chamber 294. The lower end of the piston 304 is exposed to the pressure in the cylinder 206 above the piston 200, via a passage 308 in the cover 220, so that pressure in the cylinder 206 sufficient to overcome the force of the spring 302 closes the vent passageway 286.

Figure 6:
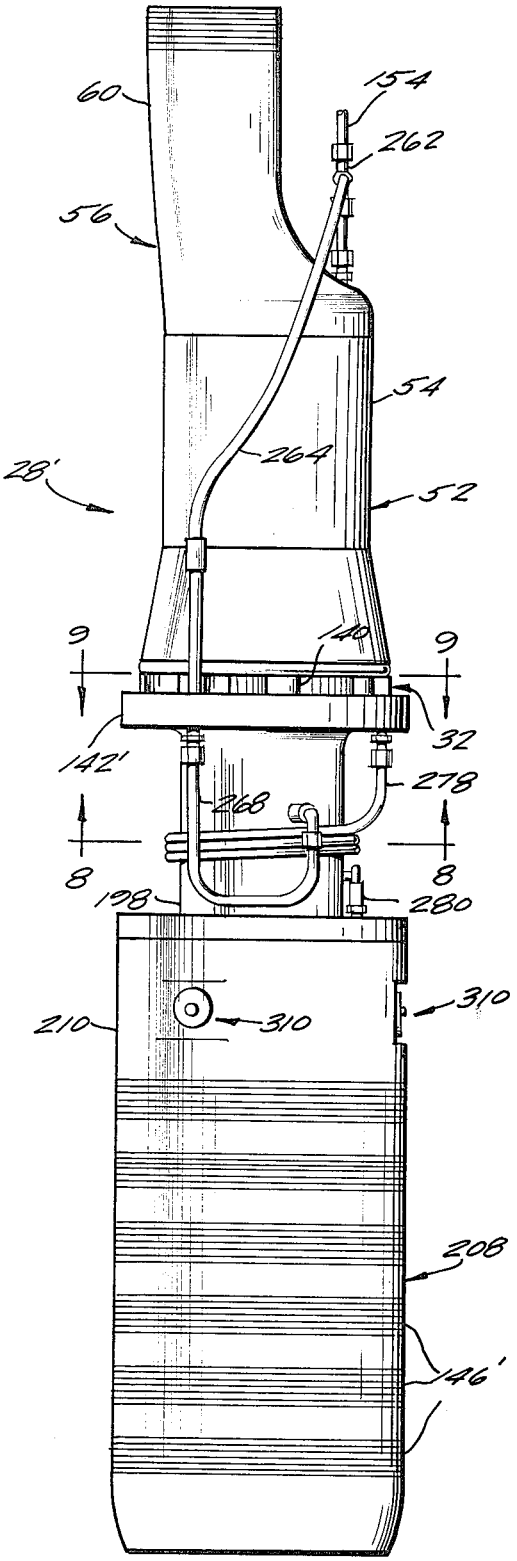
FIG. 6 is an enlarged elevational view of a modification of the turbopump unit shown in FIG. 1.

Arranged uniformly about the exterior of the upper portion of the support housing 208 are a plurality, at least three, of uniformly circumferentially spaced centering devices 310 (FIGS. 6, 10 and 13). Each device comprises a cylinder 312, which may be formed in a nut 314 threaded into a recessed tapered opening in the housing 208. The inner end of the cylinder 312 is open and communicates with the cylinder 206 above the piston 200. Slidable in the cylinder 312 and retained therein by a split ring 315 is a piston 316, preferably having sealing engagement with the cylinder 312, as by an O-ring 318. On its outer end the piston 316 is provided with a short piston rod 320 which extends snugly through a reduced cylindrical opening in the closed outer end of the cylinder 312. A coil compression spring 322 between the outer end of the cylinder and the piston 316 constantly urges the latter inwardly. The outermost extention of the piston rod 320, beyond the outer diameter of the support housing 208, is limited to approximately the spacing between the housing and the wall of the well casing 22 when the unit 28' is centered in the casing. It thus will be seen that if liquid under pressure greater than that existing in the well 20 at the depth to which the unit 28' is submerged is introduced into the cylinder 206, the piston rods 320 will be moved outwardly to substantially automatically center the unit in the well casing 22.

An alternative type of centering device 324 is shown in FIG. 14. In this arrangement an annular cylinder 326 is formed in the support housing 208 coaxially about the cylinder 206, and at one end is in communication with the latter cylinder 206 via a hole 328 or preferably a circumferentially arranged series of such holes. Slidable in the annular cylinder 326 is an annular piston 330 which is sealed to the cylinder, as by inner and outer O-rings 332, 334. At its upper end the annular piston is provided with an upwardly converging frusto-conical outer surface 336 engageable with a complementary surface 338 on the inner side of an expansible and contractible split ring 340 disposed in a circumferential groove 342 in the support housing 208. It will be seen that upward movement of the piston 330, on introduction into the cylinder 206 of liquid under pressure higher than that existing in the well 20, will expand the split ring 340 outwardly substantially uniformly about its circumference, to again substantially automatically center the unit 28' in the well. The piston 330 is constantly urged to its lower position, so that the split centering ring 340 will be retracted, by appropriate spring means, such as a plurality of coiled compression springs 344 each retained in place by a post 346 projecting from one side of the groove 342 into a clearance hole in the piston 330.

Referring now to FIG. 18 of the drawings, there is shown an arrangement for allowing the upper end of the unit-supporting conduit 38 to move vertically, in response to differential thermal expansions or contractions, while still being properly supported in the well 20. In this arrangement the upper end of the conduit 38 passes vertically through a packing box 348 on the casing head 26. Outside the casing head 26 the conduit 38 has a right angle elbow 350. A cable 352 is secured to a bracket 354 fastened to the elbow 350 and thence is trained upwardly over a fixed pulley 356, and thence over another fixed horizontally-spaced pulley 358 and downwardly where an appropriate counterweight 360 is secured to the end of the cable. The weight of the counterweight 360 is adjusted approximately to that needed to support the weight of the conduit 38 and the unit 28' in the well 20. The tube 154 may be connected to an appropriate fitting 362 in the casing head 26 with a large bend in the tube sufficient to permit it to move with the conduit 38.

An alternative to the counterweight arrangement is shown in FIG. 19 of the drawings wherein the end of the cable 352 is secured to the end of a piston rod 364 of a pneumatic cylinder 366. The pressure in the rod end of the cylinder 366 can likewise be adjusted to approximate the force necessary to support the conduit 38 and the unit 28' as aforedescribed.

OPERATION

When the unit 28' is lowered into a well 20, the support housing 208 will be supported on the piston 200, i.e. in its lowermost position relative to the piston rod 198. After the unit 28' reaches its desired depth, the valved supply line 50 and valved bleed line 184 are opened and the surface pump 46 started to supply lubricating liquid under high pressure to the unit. The lubricating liquid will pass into the cylinder 206 above the piston 200, via the tubes 154, 264, 268 and passageways 266, 270, and will raise the support housing 208 relative to the piston rod 198 on the pump shroud 142' while at the same time closing the piston-operated valve 288 in the vent passageway 286. The springs 32, 34 of the respective centering devices 312, 324 are strong enough to resist the pressure in the cylinder 206 and maintain the devices retracted until the support housing 208 is raised to its full extent with a consequent increase in pressure in the cylinder. At this time, the centering devices 310 or 324 are extended to center the unit 28 in the well. The opening pressure of the relief valve 254 is such that once the support housing 208 is raised to its fullest extent, the valve 254 will open and allow lubricating liquid under high pressure to flow into the bottoms of the circumferential grooves 148', via passageways 256, 250 and groove 252, and so expand the sealing rings 146' into firm sealing and frictional engagement with the inner surface of the well casing 22. The number of such rings 146' and their tight frictional engagement with the inner surface of the well casing 22 assures not only that leakage of water from above the rings downwardly past such rings will be neglible, but also that the support housing 208 will be engaged with the well casing 22 substantially against any vertical movement relative thereto under the vertical forces imposed on the housing during operation of the unit 28'. After the sealing rings 146' have been so expanded, the fluid pressure therebeneath will increase and open the relief valve 260 which is set to open at a pressure somewhat greater than the opening pressure of the relief valve 254. When relief valve 260 opens, liquid under high pressure is admitted to the cylinder 206 beneath the piston 200. The effective area of the undersurface of the piston 200 is substantially larger than the effective area of its upper surface so that a force is exerted on the piston to lift the unit 28', except the support housing portion 208, relative to the well casing 22, thus substantially relieving the tensile stresses in the conduit 38.

After the foregoing automatic operations have taken place, the valved discharge line 368 of the surface pump 46 is opened to supply motive liquid to the turbine 70 and thus to pump water upwardly through the well casing 22 to the surface and through the discharge conduit 36 to its point of use. The turbine motive liquid also will be supplied, at a pressure higher than that of the lubricating liquid, via the flexible tube 278, to the bottoms of the circumferential grooves 148' to thus increase the pressure urging the sealing rings 146' into frictional and sealing engagement with the inner surface of the well casing 22. At the same time, the turbine motive liquid will increase the pressure in the cylinder 206 beneath the piston 200 to thus increase the lifting force thereon. In this connection, the piston 200 can move upwardly, relative to the support housing 208, because liquid in the cylinder 206 above the piston 200 can backflow through the passage 270 or open the relief valve 254 and flow therethrough. On the other hand, should the aforedescribed tensile stresses in the conduit 38 resulting from operation of the unit 28' cause the latter to move down, it can do so when the pressure in the cylinder 206 below the piston 200 is increased to the point where it will open the pressure relief valve 284 and allow liquid in the cylinder below the piston to be vented to the well 20 below the sealing rings 146'. In this connection, the opening pressure of the relief valve 284 is substantially greater than that at which turbine motive fluid normally is supplied to the unit 28'. In the event differential thermal expansion causes the turbine supply conduit 38 to lengthen or shorten, the upper end of the conduit can move through the packing box 348 to accommodate such without causing undue tensile or compression stresses in the conduit.

On shut-down, the valved line 368 is first closed to discontinue the supply of motive fluid to the turbine 70 and thereafter the valved bleed line 184 is closed to discontinue the supply of lubricant to the unit 28'. Discontinuance of the lubricant supply relieves the pressure in the cylinder 206 above the piston 200 so that the piston-operated valve 288 will open and vent to the well 20 the expanding pressure on the sealing rings 146' so that the latter will contract. At the same time, the pistons 316 or 330, of either type of the centering devices 310 or 324, will retract so that the support housing 208 will be disengaged from the well casing 22 and the unit 28' can be removed from the well if desired.

It thus will be seen that the objects of this invention have been fully and effectively accomplished. It will be realized, however, that the specific embodiments shown and described are susceptible of modification without departure from the principles of the invention. Hence, the invention encompasses all modifications within the spirit and scope of the following claims.

I claim:

1. A turbopump unit for submergence in an encased deep well to pump liquid upwardly through the well casing to the earth's surface comprising:

turbine means having a shaft, rotor blades carried thereon, and a tubular casing coaxially enclosing said shaft and having an inlet for motive liquid at one end and an exhaust outlet at the other end;

tubular housing means coaxially enclosing said turbine means and having a top and a bottom facing said turbine casing inlet with said shaft sealingly extending through said bottom, said housing means defining with said turbine casing an annular inlet passage communicating at its bottom end with said turbine casing inlet, said top having an inlet for motive liquid connected to said inlet passage and an exhaust passage communicating said turbine casing exhaust outlet with the exterior of said housing means, said housing means being adapted to be suspended bottom-down in a well by first conduit means connected to said top inlet for supplying thereto turbine motive liquid under high pressure from the earth's surface;

first journal bearing means for the lower end of said shaft carried by said bottom;

second journal bearing means for the upper end of said shaft carried within said casing;

centrifugal pump means located exteriorly of said bottom including impeller means mounted to said shaft, shroud means spaced from said bottom and defining therewith a pump discharge outlet, said shroud means forming a downwardly facing pump inlet;

thrust bearing means for said shaft carried by said bottom and facing downwardly thereof;

thrust collar means adjacent said impeller means carried by said shaft exteriorly of said bottom means and engageable with said thrust bearing means; and means carried by said shroud means for sealing said unit to the well casing below said pump discharge outlet.

2. The unit defined in claim 1 wherein the turbine means and pump means are proportioned so that the up thrust on the shaft effected by said turbine means exceeds the down thrust on said shaft effected by said pump means.

3. The unit defined in claim 1 in which the bottom and the top are detachably fastened to the housing means.

4. The unit defined in claim 1 in which the sealing means includes radially-expansible and contractible annular means carried in circumferential groove means and including passage means for supplying motive liquid from the inlet passage to said groove means inwardly of said radially-expansible and contractible means.

5. The unit defined in claim 1 including means defining lubricant passages in said unit having an inlet adapted to be connected to second conduit means for supplying lubricating liquid from the earth's surface to said passages at a pressure higher than discharge pressure of the pump means, said passages directing the lubricating liquid to all of the bearing means for flow axially between the opposed surfaces of said journal bearing means and the shaft and radially outwardly between the opposed surfaces of the thrust bearing means and the thrust collar means to the exterior of the housing means.

6. The unit defined in claim 5 in which the lubricant inlet is in the top.

7. The unit defined in claim 5 in which the lubricant passages include axial and radial bores in the shaft for supplying lubricating liquid to the first journal bearing means and to the thrust bearing means.

8. The unit defined in claim 5 wherein the shaft is movable axially to a limited extent and including:

cylinder and piston means associated with said shaft and acted upon by the lubricating liquid to exert a substantially constant up force on said shaft; and outer circumferential lip means extending axially from one of the opposed surfaces of said thrust bearing means and said thrust collar means whereby the lubricating liquid exerts a down force on said shaft which is inversely proportional to separation distance between said opposed surfaces, the effective areas of said cylinder and piston means and said opposed surfaces inwardly of said lip means being proportioned so that on supply of lubricant prior to start-up of said unit said opposed surfaces are moved toward each other until said down force and weight of said shaft and all elements carried thereby become balanced by said up force prior to contact of said lip means with the surface opposed thereto.

9. The unit defined in claim 8 including inner circumferential lip means of lesser axial dimension than the outer lip means extending axially from one of the opposed surfaces whereby to throttle flow therebetween when the outer circumferential lip means is out of contact with the surface opposed thereto.

10. The unit defined in claim 5 in which the shaft is movable longitudinally to a limited extent and including enlarged piston means on the shaft cooperating with fixed cylinder means to define an enclosed annular space, and wherein the lubricant passages communicate with said space below said piston means, whereby the lubricating liquid exerts a substantially constant up force on said shaft, and wherein the lubricating liquid when passing between the opposed surfaces of the thrust bearing means and the thrust collar means exerts a down force on said shaft inversely proportional to separation distance between said surfaces, the effective area of the piston means and said opposed surfaces being proportioned so that on supply of lubricating liquid prior to start-up of the unit said opposed surfaces are moved toward each other by said up force until said down force and weight of said shaft and all elements carried thereby become balanced by said up force prior to contact of said surfaces.

11. The unit defined in claim 5 in which the journal bearings are hydrodynamic and the annular spaces between the opposed surfaces of said bearings and the shaft taper in radial dimension in the direction of flow of lubricating liquid therebetween whereby such flow tends to center said shaft in said bearings.

12. A turbopump unit for submergence in an encased deep well to pump liquid to the earth's surface comprising:

turbine means having a shaft and a tubular casing coaxially enclosing said shaft, said casing being adapted to be disposed upright and having an inlet for motive liquid at its lower end and an exhaust outlet at its upper end;

centrifugal pump means mounted to said shaft adjacent said casing lower end and having a downwardly-facing inlet; said unit being adapted to be suspended pump means down in a well by first conduit means for supplying motive liquid under high pressure from the earth's surface to said turbine means;

hydrodynamic journal bearing means for said shaft carried by said unit;

hydrodynamic thrust bearing means for said shaft carried by said unit;

thrust collar means on said shaft opposed to said thrust bearing means; and means defining lubricant passages in said unit adapted to be connected to second conduit means for supplying lubricating liquid from the earth's surface to said passages at a pressure higher than discharge pressure of said pump means, said passages directing the lubricating liquid to all of said bearing means for flow axially between the opposed surfaces of said journal bearing means and said shaft and radially outwardly between the opposed surfaces of said thrust-bearing means and said thrust collar means to the exterior of said unit.

13. The unit defined in claim 12 wherein the turbine means and pump means are proportioned so that the up thrust on the shaft effected by said turbine means exceeds the down thrust on said shaft effected by said pump means.

14. The unit defined in claim 12 in which the journal bearings are hydrodynamic and the annular spaces between the opposed surfaces of said bearings and the shaft taper in radial dimension in the direction of flow of lubricating liquid therebetween whereby such flow tends to center said shaft in said bearings.

15. The unit defined in claim 12 wherein the shaft is movable axially to a limited extent and including:

cylinder and piston means associated with said shaft and acted upon by the lubricating liquid to exert a substantially constant up force on said shaft; and wherein the lubricating liquid when passing between the opposed surfaces of said thrust bearing means and said thrust collar means exerts a down force on said shaft which is inversely proportional to separation distance between said opposed surfaces, the effective areas of said cylinder and piston means and said opposed surfaces being proportioned so that on supply of lubricant prior to startup of said unit said opposed surfaces are moved toward each other until said down force and weight of said shaft and all elements carried thereby become balanced by said up force prior to contact of said surfaces.

16. The unit defined in claim 15 including outer circumferential lip means extending axially from one of the opposed surfaces to constantly expose said surfaces to lubricant.

17. The unit defined in claim 16 including inner circumferential lip means of lesser axial dimension than the outer lip means extending axially from one of the opposed surfaces whereby to throttle flow therebetween when said outer circumferential lip means is out of contact with the surface opposed thereto.

18. A system for pumping hot geothermal liquid from a deep well to the surface of the earth comprising:

a turbopump unit submerged in hot geothermal liquid in a closed and encased deep well, said unit having turbine means driving centrifugal pump means having a downwardly facing inlet and an outlet thereabove;

means sealing said unit to the well casing between said inlet and said outlet;

rigid first conduit means suspending said unit in said well and for supplying motive liquid to said turbine means for driving said pump means to pump geothermal liquid from below said unit upwardly through said casing to the casing head at a pressure above boiling;

multistage centrifugal pump means at the surface having its outlet connected to said rigid conduit means for supplying turbine motive liquid to said unit at a pressure higher than discharge pressure of said unit pump means;

means defining passages in said unit for supplying lubricating liquid to journal and thrust bearing means for said shaft; and second conduit means connecting said passages to said surface pump means to receive liquid under pressure from an intermediate stage thereof and to supply such liquid to said bearing means at a pressure higher than discharge pressure of said unit pump means.

19. The system defined in claim 18 in which at least a major portion of the inflexible conduit means is straight and including resilient means urging said portion against one side of the well casing.

20. The system defined in claim 18 wherein the inlet to the surface pump means is connected to the casing head to receive therefrom geothermal liquid under pressure above boiling.

21. The system defined in claim 20 including means connected to the second conduit means for cooling and filtering liquid supplied to the bearing means.

22. A system for pumping hot geothermal liquid from a deep well to the surface of the earth comprising:

a turbopump unit submerged in hot geothermal liquid in a closed and encased deep well, said unit having turbine means driving centrifugal pump means provided with a downwardly facing inlet and an outlet thereabove;

means for sealing said unit to the well casing between said inlet and said outlet;

rigid conduit means suspending said unit in said well and for supplying turbine motive liquid under high pressure from the surface for driving said pump means to pump geothermal liquid from below said unit upwardly through said casing to the casing head at a pressure above boiling; and resilient means for urging a major straight portion of said conduit means against one side of the well casing.

23. A system for pumping hot geothermal liquid from a deep well to the surface of the earth comprising:

a turbopump unit submerged in hot geothermal liquid in a closed and encased deep well, said unit having turbine means driving centrifugal pump means having a downwardly facing inlet and an outlet thereabove;

means sealing and engaging said unit to the well casing between said inlet and outlet against relative vertical movement;

rigid conduit means suspending said unit in said well and for supplying turbine motive liquid under high pressure from the surface, said conduit means extending through the casing head;

means sealing said conduit means to said casing head while permitting relative vertical movement therebetween; and means outside said casing head for exerting an adjustable upward force on the upper end of said conduit means for suspending the latter and said unit in said well.

24. The system defined in claim 23 in which the force exerting means includes a counterweight.

25. The system defined in claim 23 in which the force exerting means includes a pneumatic cylinder.

26. A turbopump unit for submergence in a closed and encased deep well to pump liquid to the earth's surface comprising:

turbine means driving centrifugal pump means having a downwardly facing inlet and an outlet thereabove, said unit being adapted to be suspended in a well by conduit means for supplying turbine motive liquid under high pressure from the surface;

means for sealing said unit to the well casing between said pump inlet and outlet including radially expansible and contractible ring means operable by liquid under pressure to effect sealing engagement with the well casing and also frictional engagement therewith against relative vertical movement therebetween;

means mounting said sealing means to said unit for relative vertical movement therebetween; and means operable by liquid under pressure supplied from the surface after the unit has been submerged to its operational depth to sequentially raise said sealing means relative to said unit, expand said ring means into said sealing and frictional engagement with the well casing, and urge said unit upwardly relative to said sealing means to impart a lifting force for relieving tensile stresses in the conduit means.

27. The unit defined in claim 26 wherein the means for effecting sequential operations includes piston and cylinder means for raising the sealing means and for urging the unit upwardly; first pressure relief valve means for admitting pressure liquid from one end of said cylinder means to the ring means; and second pressure relief valve means for admitting pressure liquid to the other end of cylinder means.

28. The unit defined in claim 27 including third pressure relief valve means for venting the other end of the cylinder means to the exterior of the unit, and normally-open pilot valve means for venting to the exterior of the unit liquid under pressure supplied to the ring means, said pilot valve means being closed by pressure in the one end of the cylinder means.

29. The unit defined in claim 26 including:

bearing means for the turbine means and the pump means adapted to be lubricated under pressure higher than the discharge pressure of said pump means;

means defining lubricant passages in said unit having an inlet adapted to be connected to second conduit means for supplying lubricating liquid from the earth's surface to said passages at a pressure higher than discharge pressure of said pump means, said passages directing the lubricating liquid to said bearing means; and means for supplying the lubricating liquid to the means operable by liquid under pressure to effect the sequential operations.

30. The unit defined in claim 29 wherein the bearing means are adapted to be lubricated by liquid under pressure lower than that of the turbine motive liquid, and the means operable by liquid under pressure also is adapted to be connected, via a check valve, to the conduit means for supplying turbine motive liquid to increase the pressure for expanding the ring means and for urging the unit upwardly after the sealing means has been raised.

31. A turbopump unit for submergence in a closed and encased deep well to pump liquid to the earth's surface comprising:

turbine means driving centrifugal pump means having a downwardly facing inlet and an outlet thereabove, said unit being adapted to be suspended in a well by first conduit means for supplying thereto turbine motive liquid for driving said pump means to pump liquid from below said unit upwardly through the casing to the well mouth;

bearing means for said turbine means and said pump means, said unit having passages therein for supplying lubricant under high pressure to said bearing means, said passages being adapted to be connected to second conduit means for supplying thereto lubricant under pressure greater than that existing in the well at the depth to which the unit is submerged;

means for effecting a seal between said unit and the interior surface of the well casing between said pump inlet and said pump outlet, said sealing means being operable by fluid under high pressure to effect tight frictional engagement with the inner surface of the well casing against vertical movement relative thereto;

means mounting said sealing means to said unit for vertical movement relative thereto including cylinder and piston means for effecting said movement in either direction; and means adapted to be connected to the second conduit means for supplying lubricant under pressure to said cylinder and piston means and to said sealing means for sequentially moving said sealing means upwardly relative to said unit, engaging said sealing means with the inner surface of the well casing, and exerting a force to urge upward movement of said unit relative to said sealing means to relieve tensile stresses in the first conduit means.

32. The unit defined in claim 31 including means including check valve means for connecting the first conduit means to the sealing means and also to the cylinder and piston means to augment the engaging force of the sealing means and the urging force on said unit after the sequential operations have been performed.

33. A system for pumping hot geothermal liquid from a deep well to the surface of the earth comprising:

a turbopump unit submerged in hot geothermal liquid in an enclosed and encased deep well, said unit having turbine means driving centrifugal pump means provided with a downwardly facing inlet and an outlet thereabove;

means for sealing said unit to the well casing between said pump inlet and outlet including radially expansible and contractible ring means operable by liquid under pressure to effect sealing engagement with the well casing and also frictional engagement therewith against relative vertical movement therebetween;

means mounting said sealing means to said unit for relative vertical movement therebetween;

rigid conduit means suspending said unit in said well and for supplying turbine motive liquid under high pressure from the surface for driving said pump means to pump geothermal liquid from below said unit upwardly through said casing to the casing head at a pressure above boiling;

means operable by liquid under pressure supplied from the surface after the unit has been submerged to its operational depth to urge said unit upwardly relative to said sealing means to impart a lifting force for relieving tensile stresses in said conduit means, said conduit means extending through said casing head;

means sealing said conduit means to said casing head while permitting relative vertical movement therebetween; and means outside said casing head for exerting an adjustable upward force on the top end of said conduit means for suspending the latter and said unit in said well.

34. A turbopump unit for submergence in an encased deep well to pump liquid to the earth's surface comprising:

turbine means having a shaft and a tubular casing coaxially enclosing said shaft, said casing being adapted to be disposed upright and having an inlet for motive liquid at its lower end and an outlet for exhaust at its upper end;

centrifugal pump means mounted to said shaft adjacent said casing lower end and having a downwardly-facing inlet, said unit being adapted to be suspended pump means down in a well with said shaft in a vertical position by first conduit means for supplying motive liquid under high pressure from the earth's surface to said turbine means;

hydrodynamic radial bearing means for said shaft carried by said unit;

down-thrust bearing means for said shaft carried by said unit;

up-thrust bearing means for said shaft carried by said unit, said shaft being movable axially to a limited extent;

cylinder and piston means associated with said shaft and operable by fluid under pressure to exert an up thrust on said shaft in excess of the submerged weight thereof and of all parts carried thereby;

means associated with said up-thrust bearing means and operable by fluid under pressure to exert a down thrust on said shaft inversely proportional to the down position thereof relative to its fully up position, whereby together with said weight to counterbalance said up thrust effected by said cylinder and piston means and maintain the opposed surface of said up-thrust and down-thrust bearing means out of rubbing engagement during start-up of said unit; and means defining lubricant passages in said unit adapted to be connected to second conduit means for supplying lubricating liquid from the earth's surface to said passages at a pressure higher than discharge pressure of said pump means, said passages directing the lubricating liquid to all of said bearing means, to said cylinder and piston means and to said means associated with said up-thrust bearing means.

* * * * *

UNITED STATES PATENT AND TRADEMARK OFFICE

CERTIFICATE OF CORRECTION

PATENT NO. : 4,276,002

DATED : June 30, 1981

INVENTOR(S) : James Hilbert ANDERSON

It is certified that error appears in the above—identified patent and that said Letters Patent is hereby corrected as shown below:

Column 7, line 10, change "water" to -- wear --.

Column 10, line 66, change "minmized" to -- minimized --.

Signed and Sealed this

*Thirteenth* Day of *October 1981*

[SEAL]

*Attest:*

GERALD J. MOSSINGHOFF

*Attesting Officer*

*Commissioner of Patents and Trademarks*